US010548450B2

(12) United States Patent
Hess et al.

(10) Patent No.: US 10,548,450 B2
(45) Date of Patent: Feb. 4, 2020

(54) SUCTION DEVICE AND METHOD FOR OPERATING A SUCTION DEVICE

(71) Applicant: Alfred Kärcher GmbH & Co. KG, Winnenden (DE)

(72) Inventors: Stefan Hess, Leutenbach (DE); Daniel Eckstein, Winnenden (DE); Guenther Holzwarth, Backnang (DE); Juergen Steinbach, Morbach (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 151 days.

(21) Appl. No.: 14/984,594

(22) Filed: Dec. 30, 2015

(65) Prior Publication Data

US 2016/0106288 A1 Apr. 21, 2016

Related U.S. Application Data

(63) Continuation of application No. PCT/EP2013/063944, filed on Jul. 2, 2013.

(51) Int. Cl.
*A47L 11/40* (2006.01)

(52) U.S. Cl.
CPC ..... *A47L 11/4086* (2013.01); *A47L 11/4008* (2013.01); *A47L 11/4011* (2013.01); *A47L 11/4072* (2013.01); *A47L 11/4088* (2013.01)

(58) Field of Classification Search
None
See application file for complete search history.

(56) References Cited

U.S. PATENT DOCUMENTS

| | | | | |
|---|---|---|---|---|
| 4,167,799 | A | 9/1979 | Webb | |
| 4,168,563 | A | 9/1979 | O'Bryan | |
| 4,327,459 | A | 5/1982 | Gilbert | |
| 4,360,946 | A | 11/1982 | Marshall, Jr. et al. | |
| 4,849,026 | A | 7/1989 | Steinhaus | |
| 5,180,439 | A | 1/1993 | Allison | |
| 5,503,594 | A | 4/1996 | Karubian et al. | |
| 5,558,108 | A | 9/1996 | Croswell, Sr. | |
| 6,026,541 | A * | 2/2000 | Bailey | A47L 5/24 15/344 |
| 6,131,237 | A | 10/2000 | Kasper et al. | |
| 6,167,587 | B1 | 1/2001 | Kasper et al. | |
| 6,338,750 | B1 | 1/2002 | Lorini | |
| 6,446,302 | B1 | 9/2002 | Kasper et al. | |

(Continued)

FOREIGN PATENT DOCUMENTS

| | | |
|---|---|---|
| CN | 2064210 | 10/1990 |
| CN | 2401135 | 10/2000 |

(Continued)

*Primary Examiner* — Eric W Golightly
*Assistant Examiner* — Arlyn I Rivera-Cordero
(74) *Attorney, Agent, or Firm* — Womble Bond Dickinson (US) LLP

(57) ABSTRACT

A suction device, including a suction unit, a suction line arrangement that is fluidically connected to the suction unit, a fluid supplying arrangement, a discharge arrangement for fluid, which is fluidically connected to the fluid supplying arrangement, and a guide element that is couplable to the discharge arrangement and the suction line arrangement and that guides fluid from the discharge arrangement into the suction line arrangement, for cleaning the suction line arrangement.

25 Claims, 8 Drawing Sheets

(56) References Cited

U.S. PATENT DOCUMENTS

| | | | | |
|---|---|---|---|---|
| 6,836,928 | B2 | 1/2005 | Zahuranec et al. | |
| 7,272,869 | B1 | 9/2007 | Robinson | |
| 7,819,127 | B1 | 10/2010 | Huffman | |
| 2001/0039684 | A1 | 11/2001 | Kasper et al. | |
| 2002/0148071 | A1 | 10/2002 | Lee et al. | |
| 2003/0046788 | A1 | 3/2003 | Kent et al. | |
| 2003/0233727 | A1 | 12/2003 | Wheeler et al. | |
| 2004/0016824 | A1* | 1/2004 | Kawamoto | B08B 3/026 239/302 |
| 2005/0015916 | A1 | 1/2005 | Orubor | |
| 2005/0022333 | A1 | 2/2005 | McDowell et al. | |
| 2005/0023377 | A1* | 2/2005 | Kawamoto | A47K 7/04 239/504 |
| 2006/0101612 | A1 | 5/2006 | Gordon et al. | |
| 2006/0185113 | A1 | 8/2006 | Kloeppel et al. | |
| 2006/0248677 | A1* | 11/2006 | Cho | A47L 11/34 15/321 |
| 2006/0275146 | A1 | 12/2006 | Williams | |
| 2007/0016328 | A1 | 1/2007 | Ziegler et al. | |
| 2007/0061996 | A1 | 3/2007 | Boone | |
| 2008/0029129 | A1 | 2/2008 | Mann | |
| 2010/0281646 | A1* | 11/2010 | Fujiwara | A47L 5/32 15/319 |
| 2011/0107546 | A1 | 5/2011 | Spatz et al. | |
| 2011/0131753 | A1 | 6/2011 | Krebs | |
| 2011/0271985 | A1 | 11/2011 | Kubasiewicz | |
| 2013/0139347 | A1 | 6/2013 | Troff et al. | |
| 2013/0247938 | A1 | 9/2013 | Walz et al. | |
| 2013/0306108 | A1* | 11/2013 | Letera | A47L 11/34 134/21 |
| 2014/0053364 | A1 | 2/2014 | Vasudeva | |

FOREIGN PATENT DOCUMENTS

| | | |
|---|---|---|
| CN | 1313133 | 9/2001 |
| CN | 2464239 | 12/2001 |
| CN | 1351477 | 5/2002 |
| CN | 1859864 | 11/2006 |
| CN | 101803894 | 8/2010 |
| DE | 195 22 893 | 2/1996 |
| EP | 0 529 805 | 3/1993 |
| WO | WO 01/07719 | 2/2001 |
| WO | WO 2005/058118 | 6/2005 |

* cited by examiner

SUCTION DEVICE AND METHOD FOR OPERATING A SUCTION DEVICE

CROSS-REFERENCE TO RELATED APPLICATIONS

This application is a continuation of international application number PCT/EP2013/063944 filed on Jul. 2, 2013, which is incorporated herein by reference in its entirety and for all purposes.

BACKGROUND OF THE INVENTION

The invention relates to a suction (vacuum) device, including a suction unit and a suction line arrangement that is fluidically connected to the suction unit.

The invention further relates to a method for operating a suction device.

U.S. Pat. No. 5,558,108 discloses a steam cleaning method.

DE 34 28 720 A1 discloses a method for cleaning and/or drying the internal walls of long distance pipelines.

SUMMARY OF THE INVENTION

In accordance with the present invention, a suction device which is operable effectively is provided.

In accordance with an embodiment of the invention, a fluid supplying arrangement is provided, a discharge arrangement for fluid is provided, the latter being fluidically connected to the fluid supplying arrangement, and a guide element is provided that is couplable to the discharge arrangement and the suction line arrangement and that guides fluid from the discharge arrangement into the suction line arrangement, for cleaning the suction line arrangement.

After the suction device has performed a suction operation, there is always residual dirt in the suction line arrangement. This may for example result in an increased build-up of germs.

In the case of the solution according to the invention, a discharge arrangement for fluid (for example clean water or steam or a mixture of clean water and cleaning agent) is used to rinse the suction line arrangement in order to perform "internal" cleaning of the suction line arrangement. This effectively counters the build-up of germs.

A (detachable) guide element is provided that ensures that fluid from the discharge arrangement is diverted into the suction line arrangement. As a result, the suction device itself provides the fluid that is required for cleaning.

It is thus possible to perform cleaning of the suction line arrangement effectively and with a simple construction.

In particular, the guide element is formed for attachment to a discharge mouth of the discharge arrangement and/or to a suction mouth of the suction line arrangement. It is thus possible to create a "short circuit" between the discharge arrangement and the suction line arrangement in a simple manner, in order to perform a rinsing clean of the suction line arrangement.

The guide element is in particular a part that is detachable from the suction line arrangement and/or the discharge arrangement and is arranged on the suction device, or is a part separate or separable from the suction device. In normal operation of the suction device, the guide element has no function. It is only required if the suction line arrangement is to be cleaned. In this case, it is possible for the guide element to be arranged on the suction device and to have additional functions there, such as a holding function for the suction line arrangement or for part of the suction line arrangement, such as a suction tube.

It is favorable if the guide element takes the form of a support element on which a suction tube of the suction line arrangement is placeable. As a result, it may be used as a holding element for fixing the suction line arrangement on a body of the suction device. In particular, the suction tube may be placed on the support element and, with the corresponding correct positioning, a cleaning procedure may then be performed by diverting fluid from the discharge arrangement into the suction line arrangement.

It is thus also possible in a simple manner to carry out sensor monitoring, for example as regards correct positioning of the suction tube on the guide element.

Favorably, a mounting is provided for the suction tube, which is arranged in particular on a body of the suction device and by means of which the suction tube is fixable on the suction device in particular when the guide element is coupled to the suction line arrangement and the discharge arrangement. In this way, a storage mounting for the suction tube may be produced in a simple manner. Further, this allows a cleaning procedure in which the suction tube is fixed on the body of the suction device to be performed in a simple manner. The mounting in turn provides secure fixing with a fluid-tight transfer of fluid from the discharge arrangement to the suction line arrangement.

Favorably, the guide element includes at least one duct through which fluid from the discharge arrangement is configured to flow into the suction line arrangement. This makes it possible to introduce fluid from the discharge arrangement into the suction line arrangement in a simple manner.

It is then further favorable if the guide element includes a sealing arrangement for fluid-tight attachment of the discharge arrangement and fluid-tight attachment of the suction line arrangement. This minimizes load on the "environment" resulting from a cleaning procedure in which fluid is expelled from the discharge arrangement and fluid is introduced into the suction line arrangement.

It is most particularly advantageous if the suction line arrangement and the discharge arrangement are mechanically connected to one another at least in a partial region, in particular the suction line arrangement and the discharge arrangement being mechanically connected to one another in the region of their mouths. The result is effective operability for a user, since he or she need hold in particular only one element, such as a handle element for a suction tube. As a result of a mechanical connection in the region of the mouths of the suction line arrangement and the discharge arrangement, positioning, and in particular joint positioning, on the guide element in order to enable a cleaning procedure to be performed may be achieved in a simple manner.

In particular, without the guide element the discharge arrangement and the suction line arrangement are separated from one another fluidically, that is to say they each have one or more ducts for fluid that are not in fluidic contact. The fluidic contact is only made by the guide element, which provides for a type of short circuit in order to allow fluid from the discharge arrangement to be introduced into the suction line arrangement.

In one exemplary embodiment, the suction line arrangement includes at least one tube and/or at least one hose. For example, a one-part or multiple-part suction tube is provided and is then attached to a body of the suction device by way of a hose. The result is simple operability for a user.

It is further favorable if the discharge arrangement includes at least one tube and/or at least one hose. For example, the discharge arrangement includes a hose that is attached to a body of the suction device and is held on a hose and/or tube of the suction line arrangement.

In particular, the fluid supplying arrangement includes a clean water supplying arrangement and/or cleaning agent supplying arrangement and/or supplying arrangement for a mixture of cleaning agent and clean water and/or a steam generator. The clean water supplying arrangement supplies clean water. The cleaning agent supplying arrangement supplies cleaning agent. The supplying arrangement for the mixture supplies a mixture of cleaning agent and clean water. The steam generator supplies steam. Using one or more of these fluids (liquids in the case of clean water and the mixture of cleaning agent and clean water, or vapour), cleaning of the suction line arrangement may be performed. Furthermore, the suction device then has further operating modes. For example, the steam generator may be used to supply steam for cleaning purposes. The clean water supplying arrangement may be used to admix steam for example with clean water. The supply of the mixture of cleaning agent and clean water may be used to supply clean water with chemical cleaning additive.

It is then in principle possible for clean water, or a mixture of clean water and cleaning agent or steam to be used as the cleaning fluid for the suction line arrangement.

In one exemplary embodiment, a sensor, which detects correct positioning on the suction line arrangement and/or the discharge arrangement, is associated with the guide element. For example, the sensor may send a release signal, whereby a cleaning procedure is not performable without a release signal.

In particular, the sensor is arranged on the guide element. This produces a structure that is simple from a production engineering and layout point of view.

In one exemplary embodiment, the sensor takes the form of a switch, wherein a switch actuation is performed by a particular positioning of the suction line arrangement and/or the discharge arrangement on the guide element. For example, the sensor takes the form of a microswitch. With the corresponding correct positioning, it is then possible for a release signal to be sent, such that in principle the cleaning procedure of the suction line arrangement is performable.

In particular, a control arrangement is provided which, in a cleaning mode, automatically performs a cleaning procedure of the suction line arrangement, wherein in particular starting of the cleaning procedure is triggered by a user. Using the control arrangement, a cleaning procedure may then be performed in accordance with a particular presetting, wherein in particular, again after triggering of a cleaning procedure, fluid is in that case conveyed in the discharge arrangement for a particular duration and at the same time there is removal by suction in the suction line arrangement.

Favorably, a pump is provided which, in the cleaning mode, conveys fluid in the discharge arrangement and is controlled by the control arrangement. In that case, fluid is pumped from the discharge arrangement into the suction line arrangement.

Favorably, fluid is conveyed for a particular first duration, the corresponding control being performed by the control arrangement. This allows effective cleaning of the suction line arrangement to be achieved in order in particular to minimize the risk of a build-up of germs.

It is furthermore favorable if the control arrangement controls the suction unit, in particular the suction unit being operated in the cleaning mode during the conveying of fluid in the discharge arrangement. In that case, when fluid is introduced into the suction line arrangement it is also removed by suction.

Advantageously, the suction unit is operated for a particular second duration after the conveying of fluid in the discharge arrangement has been switched off. This ensures that fluid and in particular liquid in the suction line arrangement cannot flow out in the direction of the suction mouth.

In particular, the suction unit takes the form of a mobile device which is in particular movable on wheels. This produces a wide range of possible applications.

In one exemplary embodiment, the suction device also takes the form of a steam device which is configured to discharge steam. The suction device is then a steam suction device. This produces a wide range of possible applications.

In accordance with the present invention, a method which makes possible an effective cleaning operation is provided.

In accordance with an embodiment of the invention, a discharge arrangement for fluid is provided, and for cleaning the suction line arrangement fluid from the discharge arrangement is introduced into the suction line arrangement and is removed by suction in the suction line arrangement by way of a suction unit of the suction device.

In this way, once normal operation of the suction device is at an end, it is possible in a simple and effective manner to clean the suction line arrangement using "internal devices" of the suction device.

It is thus possible in an effective manner to minimize the risk of a build-up of germs in the suction line arrangement.

Further advantageous embodiments of the method according to the invention have already been described in conjunction with the suction device according to the invention.

In particular, for introducing fluid from the discharge arrangement into the suction line arrangement, a guide element is provided that is positioned at respective mouths of the discharge arrangement and the suction line arrangement. Fluid from the discharge arrangement may thus be introduced directly into the suction line arrangement.

In one exemplary embodiment, a sensor checks that the position of the guide element in relation to the suction line arrangement and/or the discharge arrangement is correct. This allows a cleaning procedure in the suction line arrangement to be performed in a simple manner.

It is favorable if a control arrangement performs cleaning automatically, wherein starting of the cleaning procedure is in particular actuated manually. This enables effective and reproducible cleaning of the suction line arrangement to be achieved. By actuating the triggering procedure manually, a user can "prepare" for the cleaning procedure.

In particular, the control arrangement initiates conveying of fluid in the discharge arrangement for a particular first duration and initiates suction in the suction line arrangement by way of a suction unit. This achieves effective rinsing of the suction line arrangement with simultaneous removal of the dirty liquid by suction.

It is further favorable if the control arrangement maintains operation of the suction unit for a particular second duration after conveying in the discharge arrangement has been switched off. This prevents liquid from being able to flow back out of the suction line arrangement to the outside.

In particular, fluid that has flowed through the suction line arrangement is received in a dirty water tank. This minimizes the load of the cleaning procedure on the outside world.

The method according to the invention may be performed using the suction device according to the invention.

The suction device according to the invention may be operated using the method according to the invention.

The description below of preferred embodiments serves, in conjunction with the drawings, to explain the invention in more detail.

DETAILED DESCRIPTION OF THE INVENTION

Figure 1:
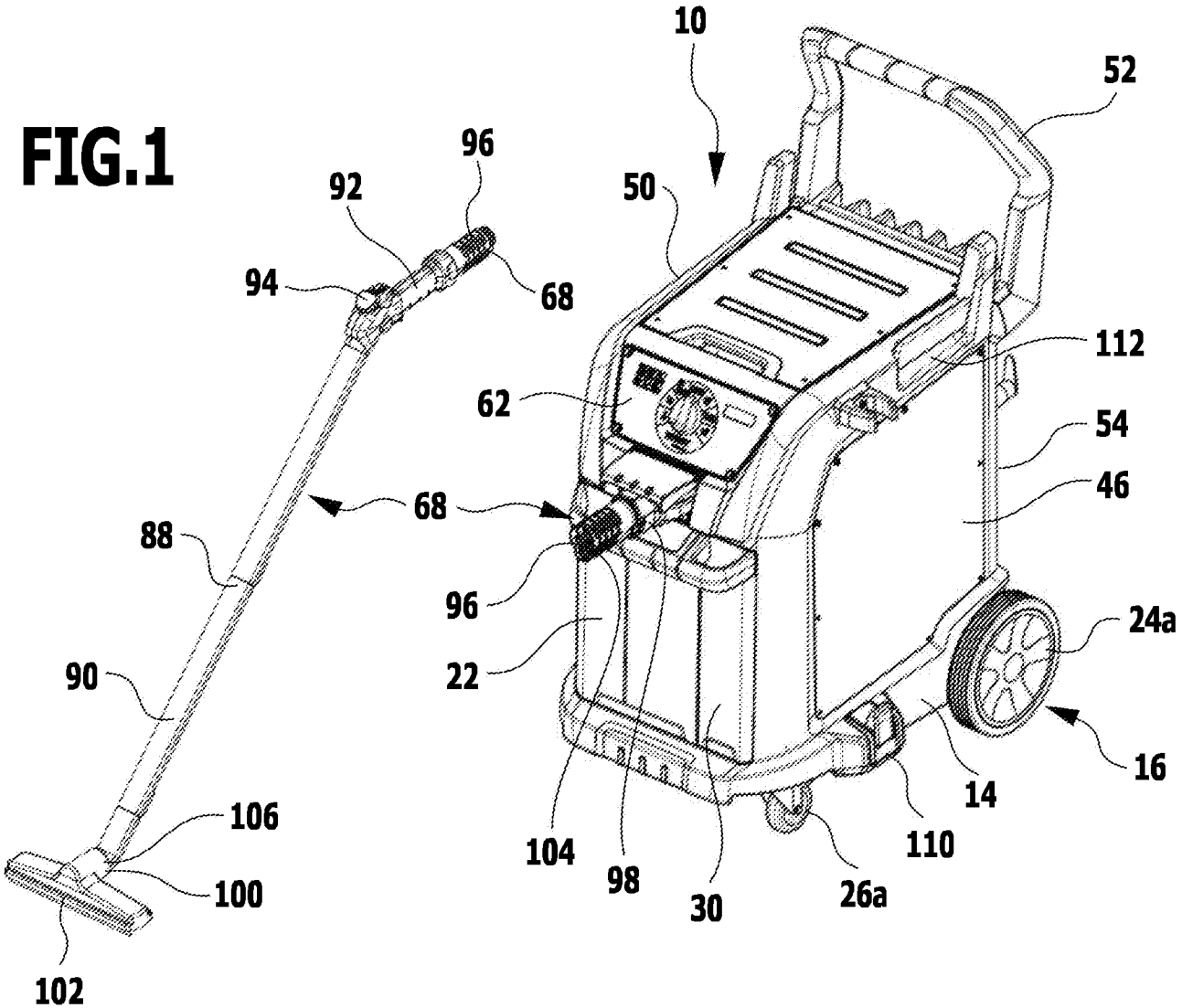
FIG. 1 shows a perspective illustration of an exemplary embodiment of a steam device that also takes the form of a suction device.

An exemplary embodiment of a steam device that is shown in FIGS. 1 to 5, and is designated 10 there, also takes the form of a suction (vacuum) device. The steam device 10 is in that case a steam suction device.

The steam device 10 has a base 14 that is in particular in the form of a plate. Arranged on the base 14 is a wheel arrangement 16 by means of which the steam device 10 is movable on wheels as a whole. The steam device 10 takes the form of a mobile device. The base 14 holds a body of the steam device 10.

In one exemplary embodiment, the wheel arrangement 16 includes a rear wheel arrangement 18 and a front wheel arrangement 20. The rear wheel arrangement 18 includes, in relation to a front side 22 of the steam device 10, a right-hand rear wheel 24*a* and a left-hand rear wheel 24*b*. The front wheel arrangement 20 includes a right-hand steering roller 26*a* and a left-hand steering roller 26*b*. By way of the wheel arrangement 16, the steam device 10 is placeable on an underlying surface.

Components of the steam device 10 are arranged on the base 14.

The steam device 10 includes a fluid supplying arrangement 28 through which fluid is suppliable.

In one exemplary embodiment, the fluid supplying arrangement 28 includes a clean water supplying arrangement 30. The clean water supplying arrangement 30 is a clean water tank 32 that is seated on the base 14 for example on or in the region of the front side 22.

The clean water tank 32 is in particular arranged on the base 14 such that it is removable for refilling.

It is in principle also possible for the clean water supplying arrangement 30 to be formed for example by an attachment to a clean water line.

Further, the fluid supplying arrangement 28 includes a cleaning agent supplying arrangement 34. This in particular takes the form of a cleaning agent tank 36.

The cleaning agent supplying arrangement 34 supplies an in particular liquid chemical cleaning additive in order to be able to supply in particular a mixture of clean water (delivered from the clean water supplying arrangement 30) and cleaning agent.

The cleaning agent tank 36 is arranged on the base 14, next to the clean water tank 32.

The fluid supplying arrangement 28 further has a steam generator 38 that is arranged on the base 14.

The steam generator 38 is fluidically connected to the clean water tank 32. The steam generator 38 generates steam from clean water.

Moreover, a suction unit 40 (vacuum unit) that includes a suction fan arrangement 42 is arranged on the base 14. By way of the suction fan arrangement 42, a suction flow for suction operation of the steam device 10 may be generated.

Arranged on the base 14 is a dirty water tank 44. The dirty water tank 44 is in particular positioned removably. Dirty water that is drawn in by suction, by means of the suction fan arrangement 42, is received in the dirty water tank 44.

The steam device 10 may be provided with power by way of the mains current, or a battery arrangement may be provided. In the latter case, a receiving arrangement for the battery arrangement is arranged on the base 14, wherein in particular the battery arrangement includes one or more rechargeable batteries.

The steam device 10 has on the body an external cladding 46, which delimits an internal chamber 48 in which the corresponding components of the steam device 10 are arranged in protected manner.

The external cladding 46 may have one or more removable elements or doors in order to enable access to corresponding components.

In one exemplary embodiment, the clean water tank 32 and the cleaning agent tank 36 are positioned on the base 14 in the manner of drawers. The clean water tank 32 and the cleaning agent tank 36 may be drawn out by way of a guide and removed from the steam device 10. In particular, the clean water tank 32 and the cleaning agent tank 36 are removable independently of one another.

In one exemplary embodiment, the dirty water tank 44 is arranged on and removable from a transverse side 50.

In one exemplary embodiment, the steam device 10 has a loop-shaped handle 52. This loop-shaped handle 52 is arranged at a rear side 54 remote from the front side 22. Using the loop-shaped handle 52, a user can push the steam device 10 as a whole. For example, the user can also tilt the steam device 10 about an axis at the rear wheel arrangement 18 such that the steam device 10 is only supported on an underlying surface by way of the rear wheel arrangement 18, in order in particular to enable an easier pushing action.

In one exemplary embodiment, holders 56 for accessories such as cleaning nozzles are arranged on the rear side 54 or the loop-shaped handle 52.

In a further exemplary embodiment, spaced-apart holders 58*a*, 58*b* for an electrical supply line are arranged at the rear end 54, and the supply line is in particular windable onto these.

The steam device 10 has a control arrangement 60. Different operating modes of the steam device 10 are controllable by the control arrangement 60.

The steam device 10 has an operating panel 62. In one exemplary embodiment, a selector switch 64 that is in particular a rotary switch is arranged on the operating panel 62, and a user can use this to select the appropriate operating mode.

Further, one or more switches 66 are arranged on the operating panel 62. For example, certain operating modes of the steam device 10 can be triggered by one or more switches.

The steam device 10 includes a discharge arrangement 68 by way of which fluid is dischargeable. The discharge arrangement 68 (cf. also FIG. 2) is for this purpose fluidically connected to the fluid supplying arrangement 28.

In one exemplary embodiment, the discharge arrangement 68 includes a first point of introduction 70 for steam from the steam generator 38. The first introduction point 70 is connected downstream of a controllable first valve 72. This first valve 72 is for example a solenoid valve and is controlled by the control arrangement 60. It is formed for example with a plurality of stages.

The first valve 72 can be used to set whether steam is introduced into the discharge arrangement 68, and what quantity of steam from the steam generator 38 is introduced into the discharge arrangement 68.

Figure 2:
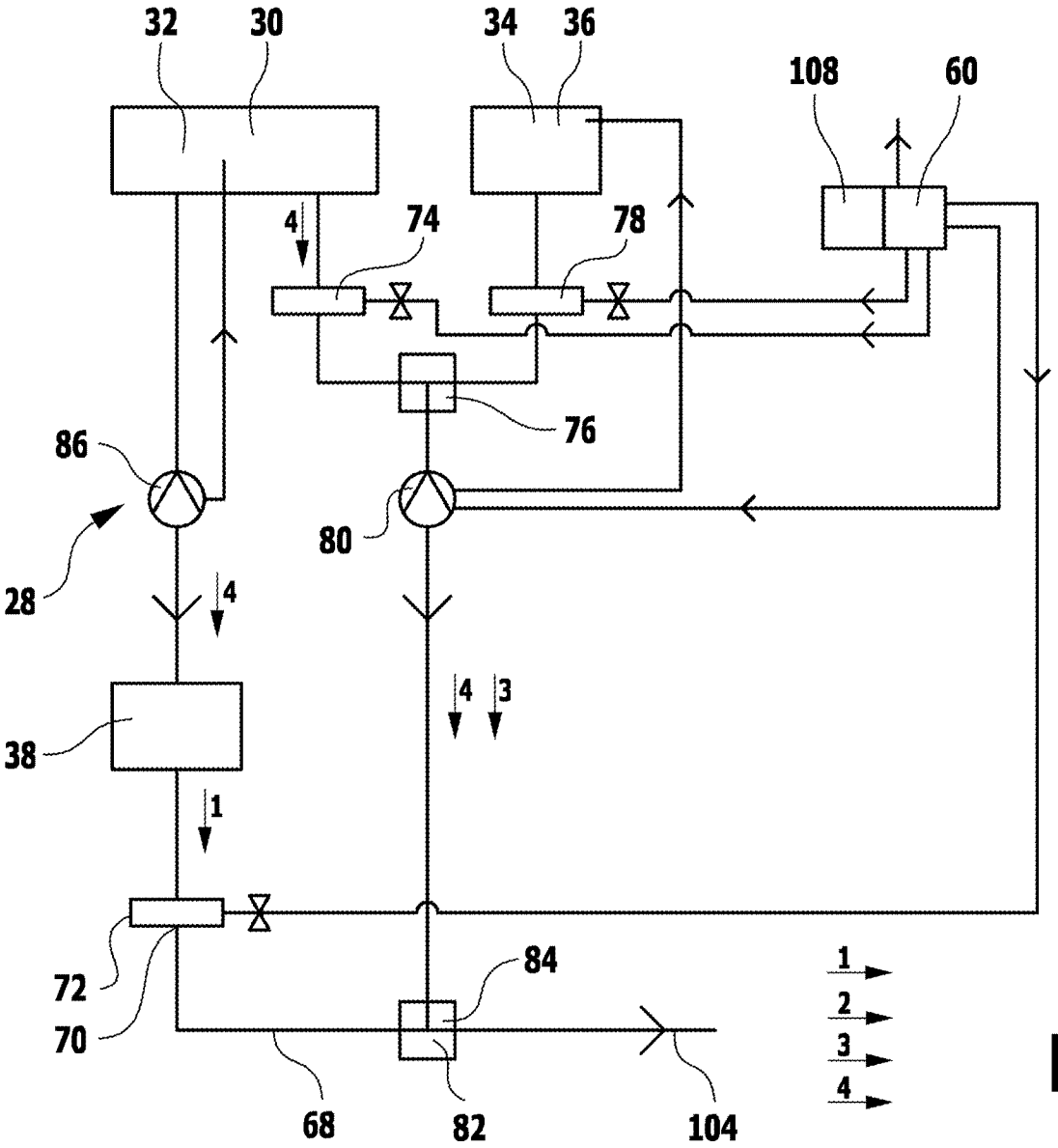
FIG. 2 shows a schematic illustration in the form of a block circuit diagram of components of the steam device according to FIG. 1.
Figure 3:
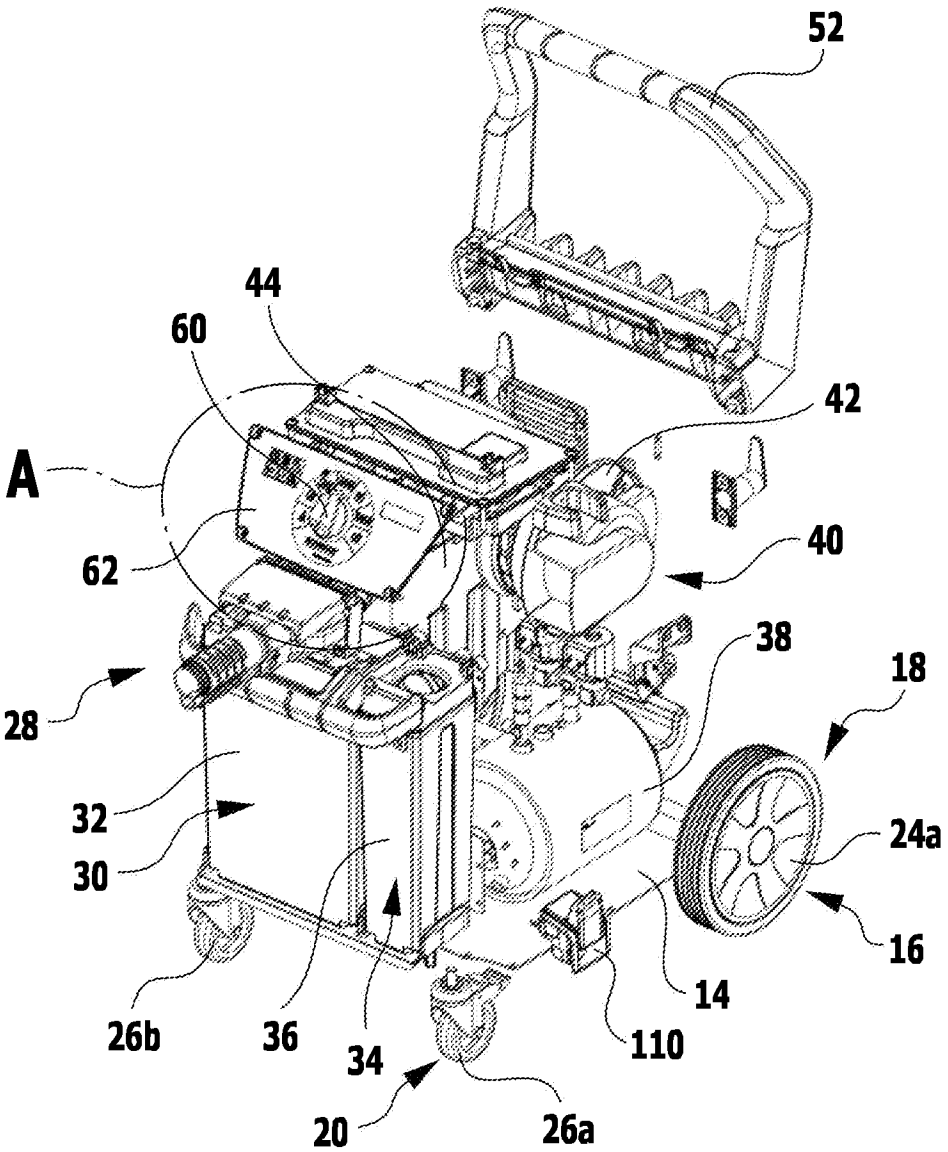
FIG. 3 shows a perspective partial illustration of the steam device according to FIG. 1, without the external cladding, in a first view.
Figure 4:
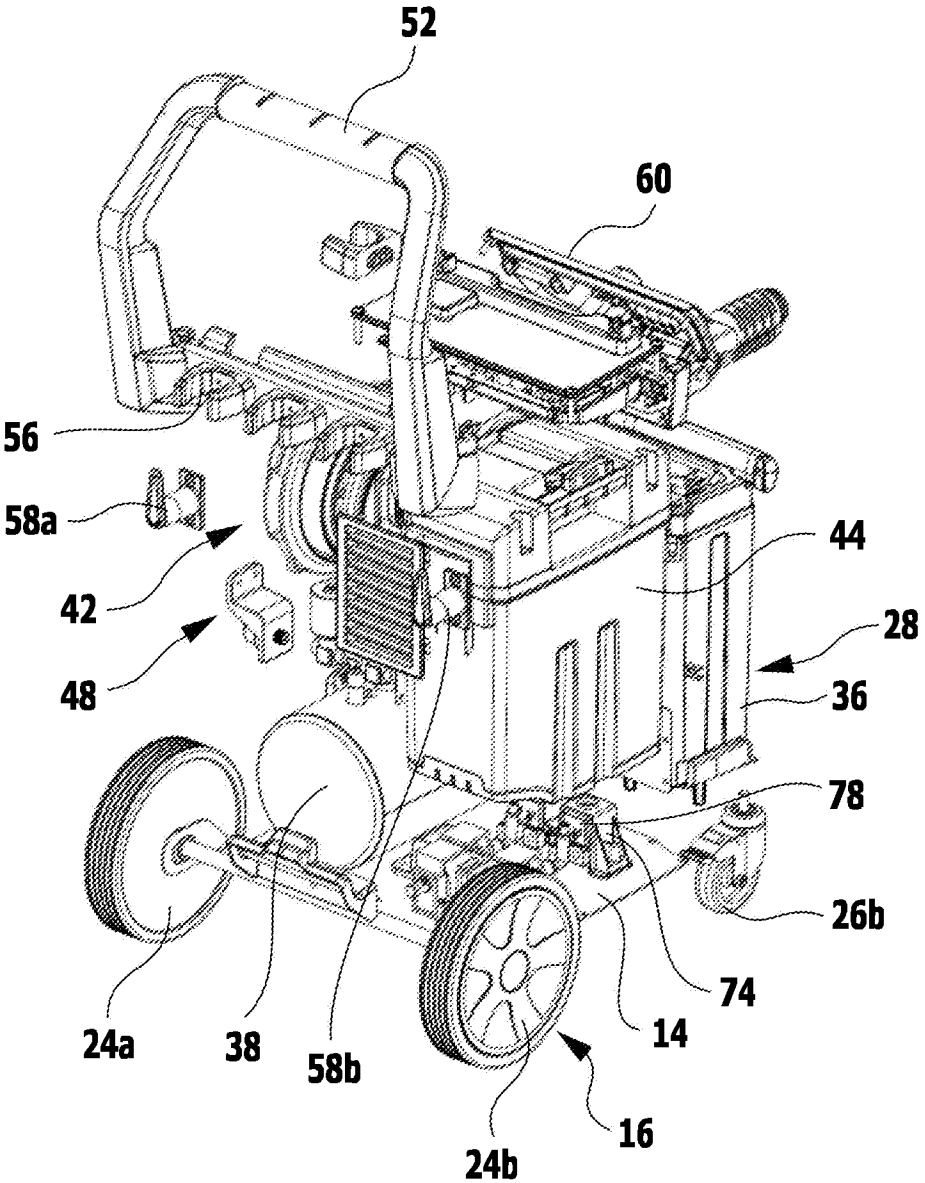
FIG. 4 shows a perspective partial illustration without the external cladding, in a second view.
Figure 5:
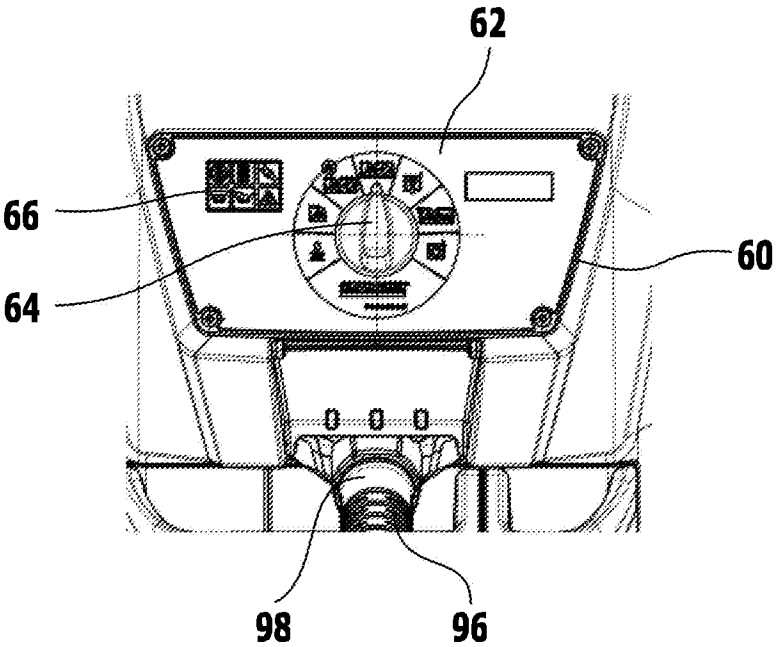
FIG. 5 shows an enlarged illustration of the region according to FIG. 3, with an operating panel and a control arrangement.

In FIG. 2, the flow of steam is symbolised by an arrow with a superscript 1.

A controllable second valve 74, which is for example a solenoid valve, is connected downstream of the clean water supplying arrangement 30. This second valve 74 is controlled by the control arrangement 60. Downstream of the second valve 74 there is connected a mixing arrangement 76 in which clean water is mixable with cleaning agent when cleaning agent is supplied to the mixing arrangement 76. The mixing arrangement 76 takes the form of a Y piece, for example.

A controllable third valve 78 is connected downstream of the cleaning agent supplying arrangement 34 and is controlled by the control arrangement 60. The third valve 78 is for example a solenoid valve.

The mixing arrangement 76 is connected downstream of the third valve 78.

If the second valve 74 is open, clean water flows to the mixing arrangement 76. If the third valve 78 is open, cleaning agent flows out of the cleaning agent tank 36 to the mixing arrangement 76, and mixing may be performed there.

For example, the third valve 78 takes the form of a metering valve in order to set the mixing ratio of cleaning agent and clean water.

If the second valve 74 is open and the third valve 78 is closed, only clean water is delivered to the mixing arrangement 76.

If the second valve 74 is closed and the third valve 78 is closed, no top-up fluid is supplied to the mixing arrangement 76.

It is provided in particular for the third valve 78 not to be capable of being open when the second valve 74 is closed. The control arrangement 60 accordingly ensures that when the second valve 74 is closed the third valve 78 cannot be open.

A first pump 80 is connected downstream of the mixing arrangement 76. On the entry side, the first pump 80 is fluidically connected to the mixing arrangement 76.

By way of a second introduction point 82, the discharge arrangement 68 is fluidically connected to the clean water supplying arrangement 30. By way of a third introduction point 84, the discharge arrangement 68 is fluidically connected to the mixing arrangement 76.

In the exemplary embodiment shown in FIG. 2, the second introduction point 82 and the third introduction point 84 coincide. These are connected to the exit side of the first pump 80.

Clean water may be supplied to the discharge arrangement 68 from the mixing arrangement 76. This is indicated in FIG. 2 by an arrow with a superscript 3. In this case the third valve 78 is closed.

A mixture of clean water and cleaning agent may also be supplied from the mixing arrangement 76. This is indicated in FIG. 2 by an arrow with a superscript 4.

It is also possible for no fluid to be supplied to the discharge arrangement 68 by the mixing arrangement 76.

Between the clean water supplying arrangement 30 with the clean water tank 32 and the steam generator 38 there is arranged a second pump 86. This second pump 86 conveys clean water from the clean water tank 32 to the steam generator 38 when the liquid there falls below a threshold level, with the result that enough clean water is supplied to the steam generator 38 for steam generation.

The steam device 10 has a steam mode in which only steam is supplied through the discharge arrangement 68. In that case, only steam flows in the discharge arrangement 68, which is indicated in FIG. 2 by the arrow with a superscript 1.

In this steam mode, the second valve 74 and the third valve 78 are closed. The first valve 72 is open, and in particular the quantity of steam supplied is adjustable. This adjustment is performed in particular at the operating panel 62, for example by way of the selector switch 64.

Further, the steam device 10 has a vapo-hydro mode in which liquid clean water is admixed with steam supplied from the steam generator 38. In this vapo-hydro mode, the discharge arrangement 68 supplies a two-phase mixture of steam and liquid. This is indicated in FIG. 2 by the arrow with a superscript 2.

In this vapo-hydro mode, the first valve 72 and the second valve 74 are open. The third valve 78 is closed.

The introduction and hence admixing of clean water at the discharge arrangement 68 is performed at the second introduction point 82. In particular, a Y piece is provided there.

The steam device 10 further has a cleaning agent mode in which a mixture of clean water and cleaning agent (as a chemical additive in the clean water) are dischargeable by way of the discharge arrangement 68.

In this cleaning agent mode, no steam is supplied; the first valve 72 is closed. The second valve 74 and the third valve 78 are open, wherein fixed metering or adjustable metering of cleaning agent may be performed.

The mixture of clean water and cleaning agent is produced at the mixing arrangement 76. This mixture is introduced, by way of the first pump 80, into the discharge arrangement 68 at the third introduction point 84 and is transported therein.

The flow of this mixture of clean water and cleaning agent is indicated in FIG. 2 by the arrow with a superscript 3.

In the steam device 10 according to the invention there is a rinsing mode in which clean water is introduced into the discharge arrangement 68, as described in more detail below. The corresponding flow is indicated in FIG. 2 by the arrow with a superscript 4. In this rinsing mode, the first valve 72 is closed and the third valve 78 is closed. The second valve 74 is open, with the result that clean water from the clean water tank 32, conveyed through the mixing arrangement 76 (with no mixing taking place there), is made to flow into the discharge arrangement 68 by the first pump 80 and then flows therein.

The valves 72, 74, 78 are arranged on the base 14.

The steam device 10 includes a suction line arrangement 88 which is fluidically connected to the suction fan arrangement 42 in order to enable it to draw by suction, and in particular to draw in liquid by suction.

In one exemplary embodiment, the suction line arrangement 88 includes a suction tube 90, which may be formed in one part or multiple parts. A handle element 92 is seated on the suction tube 90 for holding by a user. The suction tube 90 is in particular of rigid construction, and the handle element 92 is constructed accordingly.

A switch arrangement 94 having one or more switches, by way of which certain settings for operation of the steam device 10 are performable, may be seated on the handle element 92. The switch arrangement 94 is accordingly coupled to the control arrangement 60 such that signals may be transmitted.

A hose 96, of which only partial regions are shown in FIG. 1, is arranged on the handle element 92. The hose 96 is in particular of flexible form and is connected, in fixed or detachable manner, by way of an attachment 98 that is seated on a housing arranged on the base 14.

The suction line arrangement 88 has a suction mouth 100 on the tube 90. A nozzle 102 or the like is attachable to the suction tube 90 in the region of the suction mouth 100.

The discharge arrangement 68 includes a hose 104. This hose 104 is at least partially mechanically connected to the suction line arrangement 88.

In one exemplary embodiment, the hose 104 is guided on the hose 96 (suction hose) and connected thereto.

The hose 104 of the discharge arrangement 68 is furthermore guided on or in the handle element 92 and arranged on the suction tube 90.

The discharge arrangement 68 has a discharge mouth 106 that is arranged on or in the vicinity of the suction mouth 100.

In particular, the discharge mouth 106 and the suction mouth 100 are in a mechanically fixed relationship with one another.

A tool that is attachable to the suction tube 90 is in particular constructed such that a suction operation and a discharge operation are possible.

The suction line arrangement 88 and the discharge arrangement 68 also extend, over a certain region, into the internal chamber 48 of the steam device 10.

After operation of the steam device 10 in a cleaning agent mode, there will always be residues of chemical cleaning agent in the discharge arrangement 68. During a subsequent steam operation, this may produce aerosols which are ejected through the discharge mouth 106. The formation of aerosols is undesirable. The rinsing mode is provided to prevent the formation of aerosols.

Figure 6:
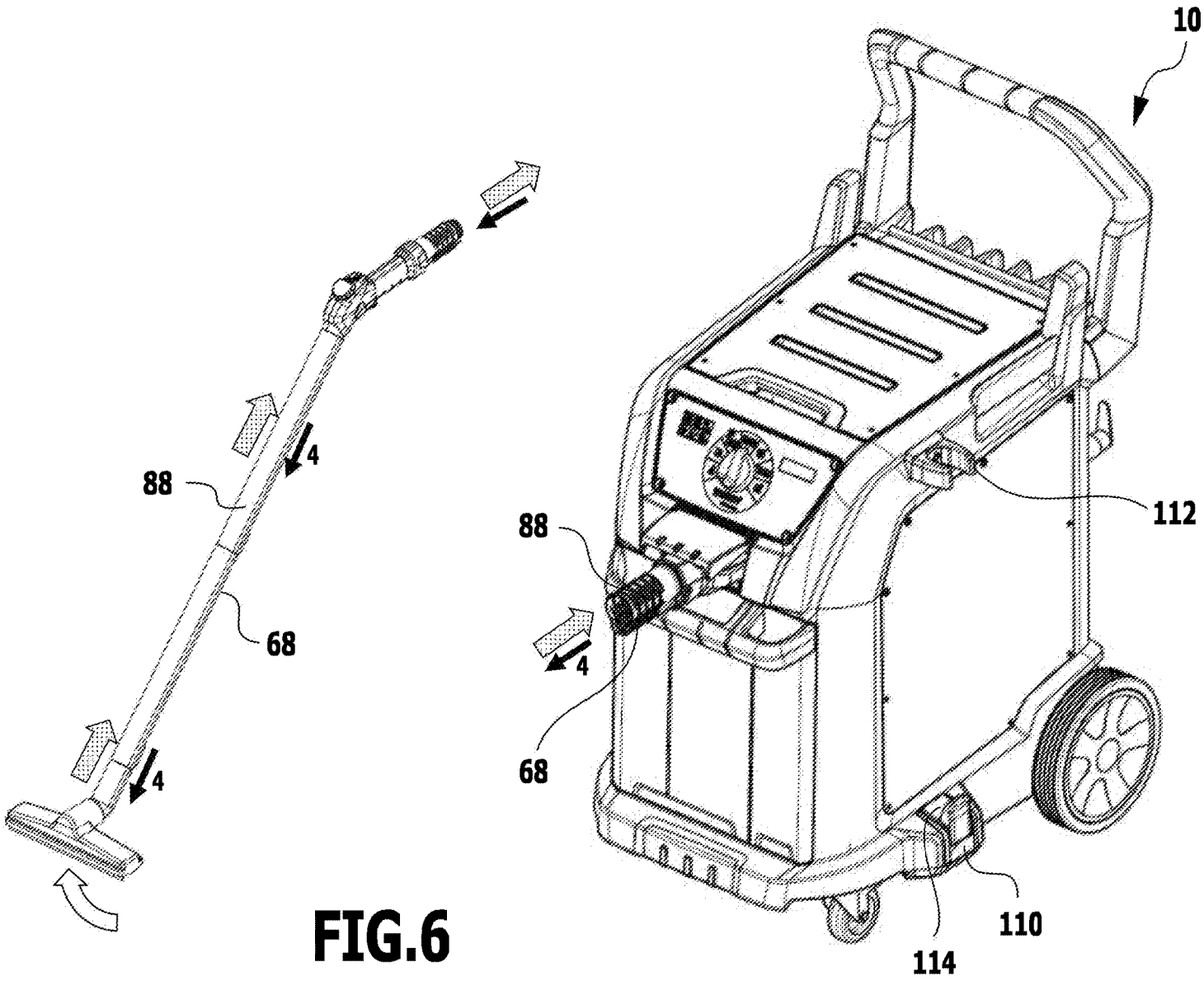
FIG. 6 shows the same view as FIG. 1, with operating modes of the steam device illustrated schematically.

During the rinsing mode, as indicated in FIG. 6, clean water flows through the discharge arrangement 68. This rinses out residual cleaning agent in the discharge arrangement 68. During a subsequent operation in steam mode, the vast majority of residual cleaning agent of this kind is then ejected, and it is no longer possible for aerosols to be formed, or the formation of aerosols is minimized.

To perform the rinsing mode, the control arrangement 60 includes a rinsing unit 108 that controls performance of the rinsing mode.

In connection herewith, it is provided for the steam device 10 to be capable of being operated in steam mode only if, after operation in the cleaning agent mode, a rinsing procedure has been performed in the rinsing mode.

For this purpose, the rinsing unit 108 has for example a corresponding memory which sets a particular memory value once operation in the cleaning agent mode has been performed.

If a user wishes for example to perform an operation in a steam mode, the control arrangement 60 only permits such an operation if the particular memory value has not been set. For this purpose, the control arrangement 60 in particular interrogates the rinsing unit 108.

When operation is set to rinsing mode at the operating panel 62, the control arrangement 60 closes the first valve 72 and the third valve 78, or a check is made as to whether the first valve 72 and the third valve 78 are already closed. Clean water rinsing is then performed for a particular duration, of for example between 10 s and 30 s, in particular between 15 s and 20 s.

To trigger a rinsing procedure of this kind, the user must in particular deliver a trigger signal. This is supplied for example by actuation of a switch at the switch arrangement 94.

Liquid is then discharged. This liquid may be drawn in by suction through the suction line arrangement 88 and received in the dirty water tank 44. A user can manually switch on a procedure for drawing in by suction, or the control arrangement 60 controls the suction unit 40 in order to effect a suction operation.

The steam device 10 also has a suction mode in which the suction unit 40 generates a suction flow, as a result of which sucked material may be drawn in by suction through the suction line arrangement 88. In particular, dirty water may be drawn in by suction. The suction operation may in this case be performed by itself or in combination with an operating mode in which fluid (liquid and/or vapour) is discharged.

Once the suction operation is complete, an internal chamber of the suction line arrangement 88 will always be dirty, and an increased build-up of germs for example is possible there.

The suction line arrangement 88 and the discharge arrangement 68 are always fluidically separated.

According to the invention, for cleaning the suction line arrangement 88 there is provided a guide element 110 through which the discharge arrangement 68, in the region of the discharge mouth 106, and the suction line arrangement 88, in the region of the suction mouth 100, are fluidically connectable to one another, with the result that fluid from the discharge arrangement 68 is introducible into the suction line arrangement 88 for the purpose of rinsing and thus cleaning it. The rinsing fluid can be received by the dirty water tank 44.

The cleaning fluid for the suction line arrangement 88 is supplied by the fluid supplying arrangement 28. Here, it is possible in principle to use as the cleaning fluid clean water, in particular from the clean water tank 32, steam from the steam generator 38, or a mixture of clean water and cleaning agent.

In a structurally favorable exemplary embodiment, clean water is used as the cleaning liquid.

Figure 7:
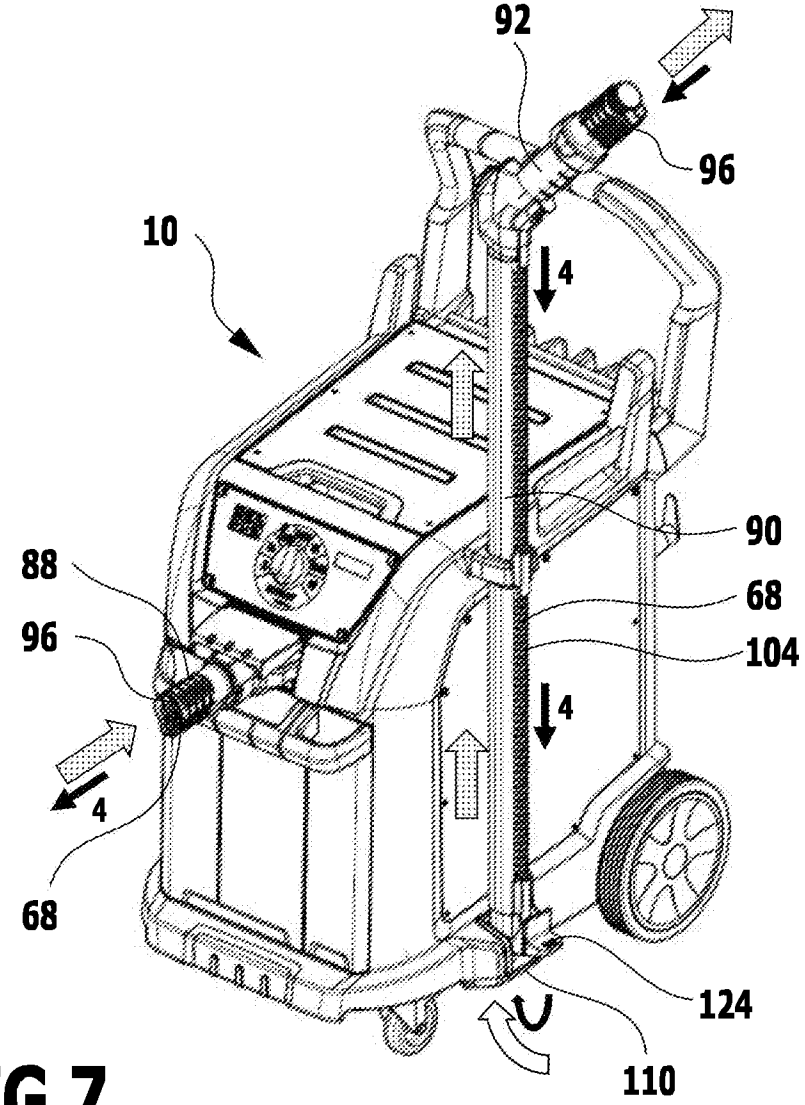
FIG. 7 shows the steam device according to FIG. 1 as a suction device, in which a suction tube for a cleaning mode is positioned on the suction device.

In one exemplary embodiment, the guide element 110 is arranged on the base 14. At a vertical spacing from the guide element 110 there is seated a mounting 112 for the suction tube 90 (with the part of the discharge arrangement 68 that is arranged thereon). The guide element 110 is formed such that the suction tube is placeable, with the part of the discharge arrangement 68 that is arranged thereon, on an upper side 114 (cf. for example FIG. 6). The suction tube 90 is placeable together with the suction mouth 100 and the discharge mouth 106. In this context, the nozzle 102 is removed. This object can be fixed in relation to the base 14 by way of the mounting 112 (cf. FIG. 7).

Figure 9:
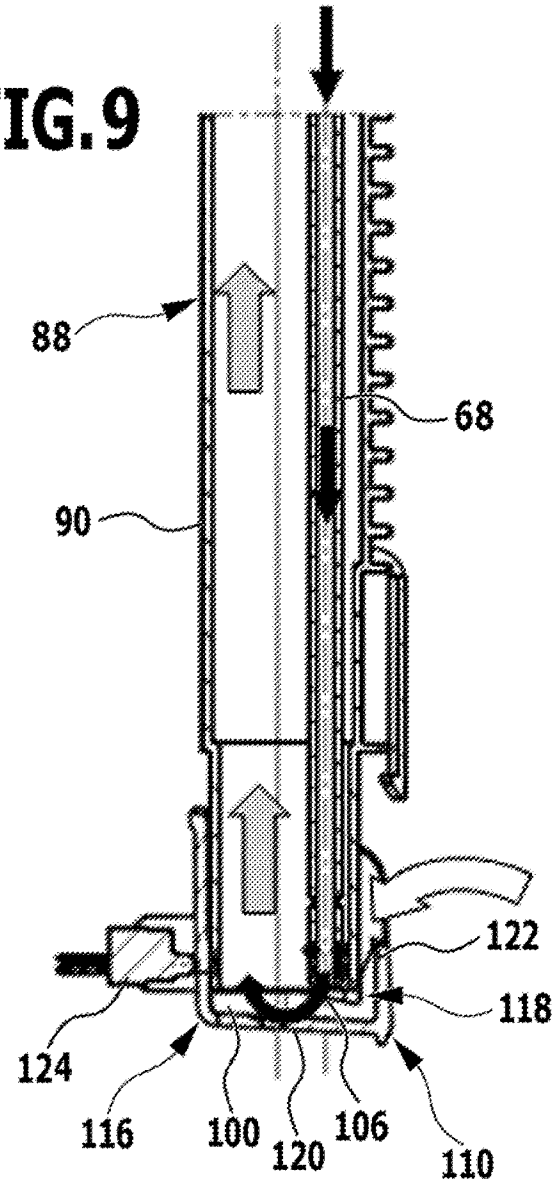
FIG. 9 shows a sectional view of a guide element with the suction tube in position and the discharge arrangement in position.
Figure 8:
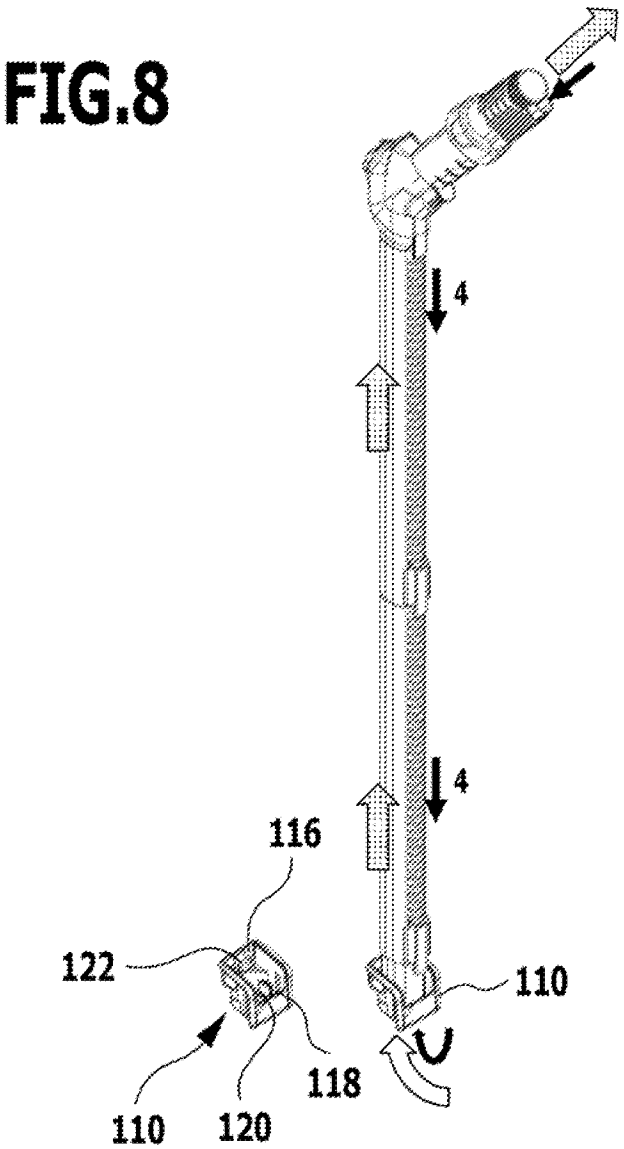
FIG. 8 shows a variant having a guide element.

As indicated in FIGS. 8 and 9, the guide element 110 includes a first receptacle 116 for the suction tube and a second receptacle 118 for the discharge arrangement 68 in the region of the discharge mouth 106. The first receptacle 116 and the second receptacle 118 are connected to one another by way of a duct 120. The duct 120 provides a type of fluid short circuit between the discharge arrangement 68 and the suction line arrangement 88.

In this context, the guide element 110 has a sealing arrangement 122 that provides for fluid-tight attachment of the suction tube to the first receptacle 116 and fluid-tight attachment of the discharge arrangement 68 to the second receptacle 118.

In the exemplary embodiment described above, the guide element 110 is fixed on the base 14, firmly in relation thereto.

It is then possible to perform a cleaning mode for the suction line arrangement 88 when the suction tube 90 is fixed accordingly in relation to the base 14 by way of the mounting 112 and the guide element 110.

It is in principle also possible, as indicated in FIG. 8, for the guide element 110 to be a separate element from the base 14 or to be a part detachable from the base 14 and attachable to the suction line arrangement 88 and the discharge arrangement 68 in order then to be able to perform a cleaning mode even when the suction tube 90 is not fixed in relation to the base 14.

In particular if the guide element 110 is fixed in relation to the base 14 and is arranged thereon, there is provided a sensor 124 which detects whether the suction tube 90, with the corresponding part of the discharge arrangement 68, is correctly positioned on the guide element 110 in order to enable fluid from the discharge arrangement 68 to be introduced into the suction line arrangement 88. The sensor 114 takes the form for example of a (micro)switch which delivers a signal, and in particular a switch signal, to the control arrangement 60 in the event of correct positioning. This switch signal is in particular a release signal for a rinsing procedure.

The control arrangement 60 controls performance of the cleaning mode. For example, the cleaning mode is initiated manually, for example by corresponding actuation at the operating panel on the handle element 92. If a sensor 124 is provided, then in particular performance is only possible if a corresponding release signal is present.

In particular, the cleaning procedure in the cleaning mode is controlled by the control arrangement 60 such that, for a particular first duration, fluid (in particular clean water) from the discharge arrangement 68 is introduced into the suction line arrangement 88 by means of the guide element 110. This duration is for example in the range between 10 s and 30 s, for example approximately 20 s.

The control arrangement 60 then also controls the suction unit 40 such that the liquid is drawn in by suction and is delivered to the dirty water tank 44.

During the particular first duration, the control arrangement 60 controls in particular the first pump 80 in order to convey fluid and in particular clean water in the discharge arrangement 68.

Once the particular first duration has elapsed, the first pump 80 is switched off.

In one embodiment, the control arrangement ensures, by a corresponding control of the suction unit 40, that a suction operation is maintained for a particular second duration. This particular second duration is for example in the range between 10 s and 25 s, for example approximately 15 s. The result is as complete as possible a removal by suction of fluid from the suction line arrangement 88.

After the cleaning mode has been performed, the internal region of the suction line arrangement 88 has been cleaned and the risk of a build-up of germs, for example, is minimized.

The cleaning mode can also be performed on the device 10 if this has no steam generating function and is in particular a suction device.

LIST OF REFERENCE NUMERALS

10 Steam device
12 Steam suction device
14 Base
16 Wheel arrangement
18 Rear wheel arrangement
20 Front wheel arrangement
22 Front side
24*a* Right-hand rear wheel
24*b* Left-hand rear wheel
26*a* Right-hand steering roller
26*b* Left-hand steering roller
28 Fluid supplying arrangement
30 Clean water supplying arrangement
32 Clean water tank
34 Cleaning agent supplying arrangement
36 Cleaning agent tank
38 Steam generator
40 Suction unit
42 Suction fan arrangement
44 Dirty water tank
46 External cladding
48 Internal chamber
50 Transverse side
52 Loop-shaped handle
54 Rear side
56 Holder
58*a* Holder
58*b* Holder
60 Control arrangement
62 Operating panel
64 Selector switch
66 Switch
68 Discharge arrangement
70 First introduction point
72 First valve
74 Second valve
76 Mixing arrangement
78 Third valve
80 First pump
82 Second introduction point
84 Third introduction point
86 Second pump
88 Suction line arrangement
90 Suction tube
92 Handle element
94 Switch arrangement
96 Hose
98 Attachment
100 Suction mouth
102 Nozzle

104 Hose
106 Discharge mouth
108 Rinsing unit
110 Guide element
112 Mounting
114 Upper side
116 First receptacle
118 Second receptacle
120 Duct
122 Sealing arrangement
124 Sensor

The invention claimed is:

1. A suction device, comprising:

a suction unit;

a suction line arrangement that is fluidically connected to the suction unit;

a fluid supplying arrangement;

a discharge arrangement for fluid, which is fluidically connected to the fluid supplying arrangement; and a guide element that is couplable to the discharge arrangement and the suction line arrangement and that guides fluid from the discharge arrangement into the suction line arrangement, for cleaning the suction line arrangement;

wherein the guide element includes at least one duct through which fluid from the discharge arrangement is configured to flow into the suction line arrangement;

wherein a first receptacle for the suction arrangement and a second receptacle for the discharge arrangement are provided on the duct and the duct being outside of the suction arrangement and the discharge arrangement;

wherein there is associated with the guide element a sensor, which detects correct positioning on at least one of the suction line arrangement and the discharge arrangement; and wherein the guide element includes a sealing arrangement for fluid-tight attachment of the discharge arrangement and fluid-tight attachment of the suction line arrangement.

2. The suction device according to claim 1, comprising a control arrangement, and wherein the sensor delivers a signal to the control arrangement in the event of correct positioning on at least one of the suction line arrangement and the discharge arrangement.

3. A suction device, comprising:

a suction unit;

a suction line arrangement that is fluidically connected to the suction unit;

a fluid supplying arrangement;

a discharge arrangement for fluid, which is fluidically connected to the fluid supplying arrangement; and a guide element that is couplable to the discharge arrangement and the suction line arrangement and that guides fluid from the discharge arrangement into the suction line arrangement, for cleaning the suction line arrangement;

wherein the guide element includes at least one duct through which fluid from the discharge arrangement is configured to flow into the suction line arrangement;

wherein a first receptacle for the suction arrangement and a second receptacle for the discharge arrangement are provided on the duct and the duct being outside of the suction arrangement and the discharge arrangement;

wherein the duct of the guide element is enclosed such that fluid flowing from the discharge arrangement into the suction line arrangement is retained within the guide element; and wherein the guide element includes a sealing arrangement for fluid-tight attachment of the discharge arrangement and fluid-tight attachment of the suction line arrangement.

4. The suction device according to claim 3, wherein the guide element is adapted for attachment to at least one of a discharge mouth of the discharge arrangement and a suction mouth of the suction line arrangement.

5. The suction device according to claim 3, wherein the guide element is a part that is detachable from at least one of the suction line arrangement and the discharge arrangement and is arranged on the suction device, or is a part separate or separable from the suction device.

6. The suction device according to claim 3, wherein the suction line arrangement and the discharge arrangement are mechanically connected to one another at least in a partial region.

7. The suction device according to claim 3, wherein without the guide element the discharge arrangement and the suction line arrangement are separated from one another fluidically.

8. The suction device according to claim 3, wherein the suction line arrangement includes at least one of at least one tube and at least one hose.

9. The suction device according to claim 3, wherein the discharge arrangement includes at least one of at least one tube and at least one hose.

10. The suction device according to claim 3, said suction device taking the form of a mobile device.

11. The suction device according to claim 3, said suction device taking the form of a steam device which is configured to discharge steam.

12. The suction device according to claim 3, wherein the guide element is detachable from the discharge arrangement and/or the suction line arrangement, and wherein the guide element is configured to be attached to the discharge arrangement and/or the suction line arrangement before cleaning the suction line arrangement.

13. The suction device according to claim 3, wherein the duct is a fluid-tight enclosure directing a fluid-tight transfer of fluid from the discharge arrangement to the suction line arrangement.

14. The suction device according to claim 3, wherein the guide element takes the form of a support element on which a suction tube of the suction line arrangement is placeable.

15. The suction device according to claim 14, comprising a mounting for the suction tube, by means of which the suction tube is fixable on the suction device.

16. The suction device according to claim 3, wherein the fluid supplying arrangement includes at least one of a clean water supplying arrangement, a cleaning agent supplying arrangement, a supplying arrangement for a mixture of cleaning agent and clean water, and a steam generator.

17. The suction device according to claim 16, wherein clean water, or a mixture of clean water and cleaning agent, or steam is provided as the cleaning fluid for the suction line arrangement.

18. The suction device according to claim 3, wherein there is associated with the guide element a sensor, which detects correct positioning on at least one of the suction line arrangement and the discharge arrangement.

19. The suction device according to claim 18, wherein the sensor is arranged on the guide element.

20. The suction device according to claim 18, wherein the sensor takes the form of a switch, and wherein a switch actuation is performed by a particular positioning of at least one of the suction line arrangement and the discharge arrangement on the guide element.

21. The suction device according to claim 3, comprising a control arrangement which, in a cleaning mode, automatically performs a cleaning procedure of the suction line arrangement.

22. The suction device according to claim 21, comprising a pump which, in the cleaning mode, conveys fluid in the discharge arrangement and is controlled by the control arrangement.

23. The suction device according to claim 22, wherein fluid is conveyed for a particular first duration.

24. The suction device according to claim 22, wherein the control arrangement controls the suction unit.

25. The suction device according to claim 24, wherein the suction unit is operated for a particular second duration after the conveying of fluid in the discharge arrangement has been switched off.

* * * * *